United States Patent [19]

Kirby, Jr.

[11] 3,933,092

[45] Jan. 20, 1976

[54] PRINTING APPARATUS

[75] Inventor: Raymond L. Kirby, Jr., Vandalia, Ohio

[73] Assignee: Monarch Marking Systems, Inc., Dayton, Ohio

[22] Filed: Dec. 30, 1974

[21] Appl. No.: 537,630

[52] U.S. Cl. ..... 101/105; 101/69; 101/288

[51] Int. Cl.[2] ..... B41J 27/12

[58] Field of Search ..... 101/57, 68, 69, 70, 103, 101/105, 111, 288

[56] References Cited

UNITED STATES PATENTS

| | | | |
|---|---|---|---|
| 1,143,445 | 6/1915 | Scotford | 101/111 |
| 3,380,378 | 4/1968 | Edwards | 101/111 |
| 3,601,042 | 8/1971 | Hamisch | 101/69 |
| 3,762,317 | 10/1973 | Hamisch | 101/68 |
| 3,767,098 | 10/1973 | Pabodie | 226/117 |
| 3,791,291 | 2/1974 | Macune | 101/69 |
| 3,796,152 | 3/1974 | Finke | 101/111 |
| 3,832,943 | 9/1974 | Kirby | 101/103 |

*Primary Examiner*—Harland S. Skogquist
*Attorney, Agent, or Firm*—Joseph J. Grass

[57] ABSTRACT

There is disclosed printing apparatus having a pivotally mounted print head which cooperates with a platen, a cam shaft to which a cam is secured for actuating the print head and to which another cam is secured for driving an operating lever. The operating lever is coupled to a slide which drives a feed finger and cam means for actuating an inker. The travel of the feed finger is selectively variable by changing the position of the pivot on which the lever is mounted. The cam means is part of a lost-motion connection which couples the slide to the inker. As the operating lever is cammed in one direction to move the feed finger forward, the inker is moved into and out of inking cooperation with the print head assembly. Because of the lost-motion connection adjustment of the pivot does not affect the length of travel of the inker. When the inker is in inking position the inker is supported at both sides of the platen thereby leaving the platen accessible during threading of the apparatus with the web of record members. The print head assembly includes a pair of print heads, each print head having at least one series of rotatably mounted drive wheels and a support. A plurality of printing bands having different printing elements are trained about the support and respective drive wheels. Each support of each print head is adjustable by exerting forces at opposite ends of the support so that all the printing elements at the support are disposed in a common plane parallel to the platen. The print heads are rigidly interconnected by plates. Set screws threadably received by one of the plates are accessible from about the print head and act on adjusting plates which exert forces at opposite ends of the respective supports.

27 Claims, 16 Drawing Figures

FIG-1
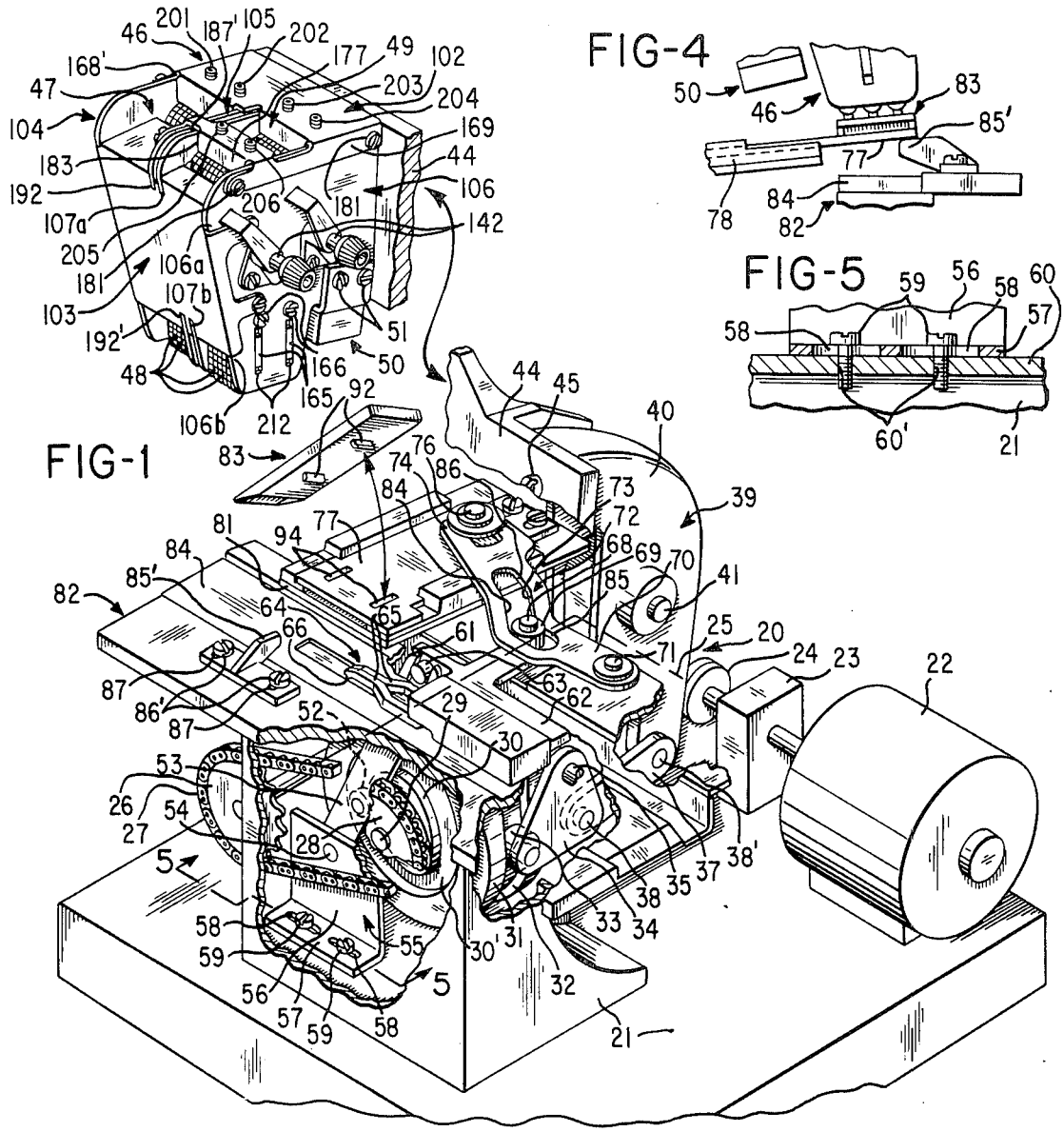
FIG-4
FIG-5
FIG-2
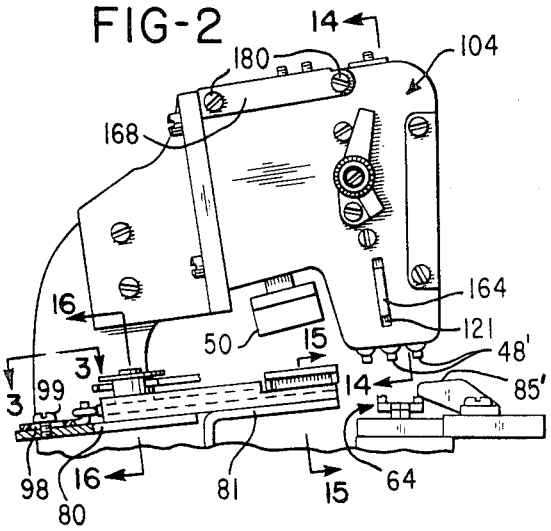
FIG-3
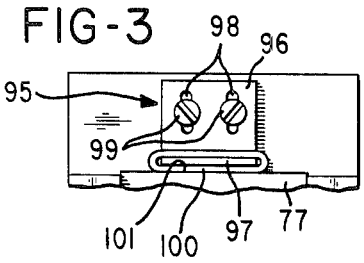

PRINTING APPARATUS

BACKGROUND OF THE INVENTION

1. Field of the Invention

This invention relates to the art of printing apparatus.

2. Brief Description of the Prior Art

Prior art printing apparatus employing feed fingers for feeding a web of record members to a printing position between a print head and a platen, include drive mechanisms comprising a cam, an operating lever driven by the cam and an adjustably mounted pivot, such that adjustment of the pivot will change the relative position between the cam and the follower carried by the operating lever to vary the stroke of the operating lever and the feed finger so that record members of different lengths can be successively adjusted to the printing position. In such an apparatus the drive for the inker has been coupled directly to the operating lever so that a change in the stroke of the operating lever will change the distance through which the inker travels. Prior art U.S. patent to Pabodie, U.S. Pat. No. 3,767,098, patented Oct. 23, 1973 discloses a cam actuated inking mechanism.

Print head assemblies comprising a plurality of print heads are known in the prior art, as in U.S Pat. No. 3,601,042 to Hamisch, Sr., patented Aug. 24, 1971.

U.S. Pat. No. 570,264 to Otteson, patented Oct. 27, 1896 discloses a hand stamp having a support or block. Nuts are provided for adjusting the position of the frame with reference to the block.

SUMMARY OF THE INVENTION

The purpose of the invention is to provide an improved printing apparatus having structural features which enable it to provide good quality printing. Adjustment of the feeding stroke of the feed finger is accomplished without affecting the travel of the inker. This is accomplished by means of a lost-motion connection between a slide, which carries the feed finger, and the inker. The lost-motion connection is provided by a cam mechanism having inclined and dwell portions so that the inker is only actuated during the central or intermediate portion of travel of the slide. Consequently the ink pad of the inker will be presented between the print head assembly and the platen at the proper time in the cycle and will be returned to its home position before the print head assembly prints on a record or record members disposed on the platen in that the length of travel of the inker is always the same. A relatively narrow ink pad can be used in that the position which the ink pad occupies during inking of the print head assembly does not change irrespective of the length of travel of the feed finger. The inker comprises a carrier and a low cost ink pad which is removably mounted to the carrier. The carrier is guided and supported by suitable structure disposed on one side of the platen and when the ink pad is in the inking position the carrier is also supported by a support at the other side of the platen, thereby allowing ready access to the platen which facilitates threading of the apparatus with the web of record members. A decelerator is used to decelerate the carrier and the ink pad which it carries and to deaden any noise resulting from the abrupt stopping of the carrier when it reaches the home position. The print head assembly is of rugged construction. The print head assembly comprises one and preferably more print heads each of which is secured to a plate of an actuator. Each print head has a series of rotatably mounted drive wheels and a movably mounted support. Printing bands having different printing elements are trained about the support and respective drive wheels. According to the invention, means are provided to orient the support so that the printing elements are positioned parallel to the platen. Moreover, the printing elements of one print head can be adjusted relative to the printing elements of the other print head or heads so that all the printing elements are in a common plane. Specifically, an adjusting plate is disposed between an endmost drive wheel of the series and the adjacent side plate. The adjusting plates exert forces on the opposite ends of the support to properly orient the support. The adjusting plates have flanges at their upper ends. The adjusting plates can be adjusted by means of screws acting on the flanges. The screws are preferably threadably received in a structural plate which interconnects the print head. The adjusting plates can be adjusted from above the print head assembly. It is also preferred to provide another plate keyed to the ends of the side plates opposite the actuator. The structural plates and the actuator plate lock the print heads into a rigid assembly. It is also preferred to lock the supports in their adjusted position by means of slight clamping force applied to the side plates.

BRIEF DESCRIPTION OF THE DRAWINGS

FIG. 1 is a partly exploded perspective view of printing apparatus in accordance with the invention;

FIG. 2 is a fragmentary left-side elevational view of the apparatus;

FIG. 3 is a view taken generally along line 3—3 of FIG. 2;

FIG. 4 is a fragmentary side elevational view showing a portion of the structure of FIG. 2, but with the ink pad being shown in the inking position;

FIG. 5 is a sectional view taken generally along line 5—5 of FIG. 1;

DETAILED DESCRIPTION OF THE PREFERRED EMBODIMENT

Figure 6:
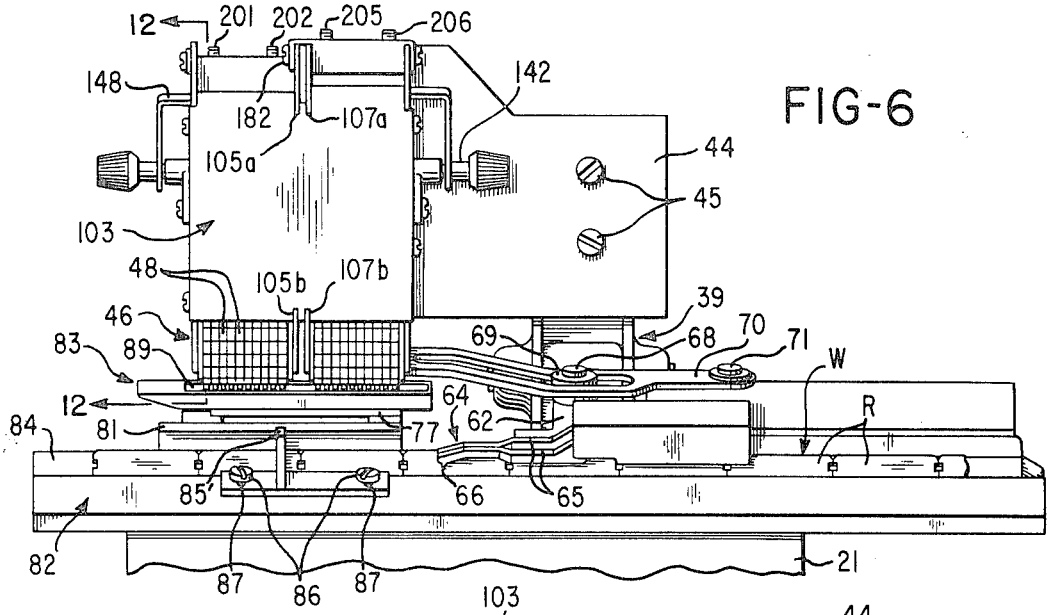
FIG. 6 is a front elevational fragmentary view showing the upper portion of the apparatus, the print head assembly, the feed finger and the inker being in their home positions.

With reference to FIG. 1, there is shown a printing apparatus 20 in accordance with the invention. The apparatus 20 is shown to include a frame 21, an electric motor 22 suitably secured to the frame 21, a speed reducer 23 coupled to the electric motor 22, and a clutch 24 coupled to the speed reducer 23. The clutch 24 is connected as indicated by a broken line 25 to a sprocket 26. The sprocket 26 is shown to drive a roller chain 27 which in turn drives a sprocket 28. The sprocket 28 is secured to cam shaft 29 to which a plate-like cam 30 having a continuous cam groove 30′ and a barrel cam 31 are secured. The cam shaft 29 is suitably rotatably mounted by the frame 21. The cam 31 has a continuous cam groove 32. A roller 33 mounted by a plate 34 is received in the groove 32. The plate 34 is pivotally mounted by a post 35 secured to the frame 21. A link 37 is connected to the plate 34 by a pin 38 and to an actuator, generally indicated at 39 in the form of a lever 40, by a pin 38′. The actuator 39 is pivotally mounted on a pin or pivot 41 suitably mounted to the frame 21. A plate 44 is bolted to lever 40 by bolts 45. The plate 44 can be considered to be part of the actuator 39. A print head assembly generally indicated at 46 is secured to the plate 44. The print head assembly 46 includes a print head 47 illustrated as having one row of printing bands 48 and another print head 49 having two rows or printing bands 48. An ink cartridge generally indicated at 50 is suitably secured to the print head assembly 46 as by screws 51.

A roller 52 rotatably mounted to a lever 53 is captive in cam groove 30′. The lever 53 is pivotally mounted at its lower end by a pin 54 carried by a bracket 55. The bracket 55 has an upstanding portion 56 and a perpendicularly extending flange 57. The flange 57 has a pair of elongated slots 58. Bolts 59 pass through slots 58 and are threaded into holes 60′ in upper wall 60 of the frame 21. It is apparent that the position of the bracket 55 and of the pivot 54 can be changed by loosening the bolts 59 and shifting the bracket 55 and then tightening the bolts 59.

Figure 7:
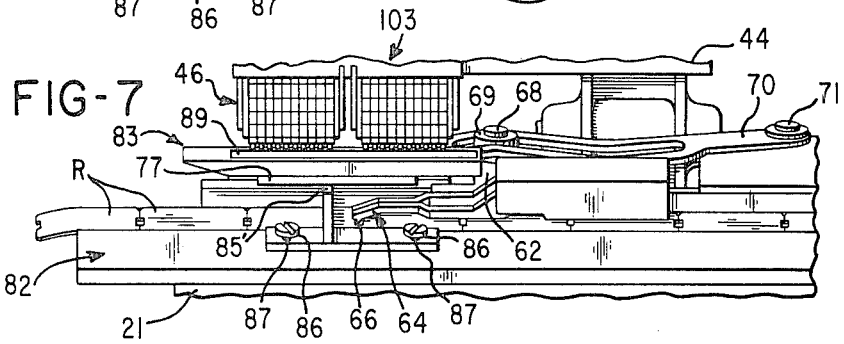
FIG. 7 is a view similar to FIG. 6, but showing only a fragmentary portion of the print head assembly, with the print head assembly raised, the ink pad being between the print head assembly and the platen and the feed finger being almost entirely in its forward position.
Figure 8:
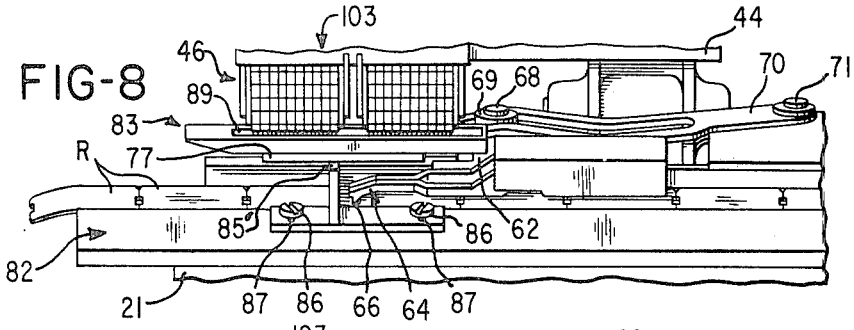
FIG. 8 is a view similar to FIG. 7, but showing the print head assembly lowered to receive ink from the ink pad and with the feed finger being in its fully forward position.
Figure 9:
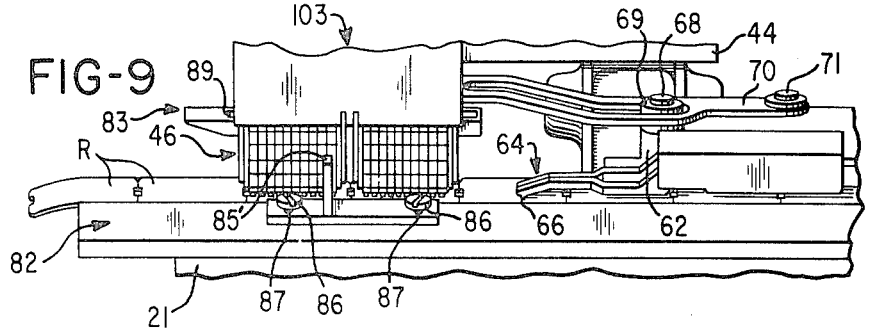
FIG. 9 is a view similar to FIGS. 7 and 8, but showing the print head assembly in its printing position with the feed finger and the ink pad being fully retracted.
Figure 16:
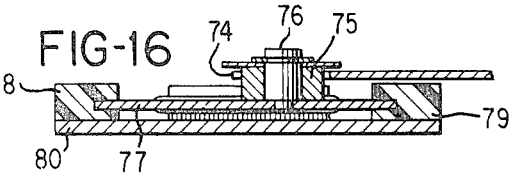
FIG. 16 is a sectional view taken generally along line 16—16 of FIG. 2.

The upper end of the lever 53 is fork-shaped as indicated at 61. A slide 62 is slideably mounted for movement to the left and to the right as viewed in FIGS. 6 through 9. The slide 62 has a pin 63 received in the fork-shaped end 61. The slide 62 carries a feed finger generally indicated at 64. The feed finger 64 is shown to be comprised of a pair of finger elements 65. Each finger element has a projection 66 for engaging a notch N in a web W of record members R. The record members can for example be tags interconnected in strip or web form or pressure sensitive labels removably carried on a web of supporting material. It is apparent that as the cam shaft 29 makes one complete revolution upon tripping of the single-revolution clutch 24, the cam 30 first pivots the lever 53 in the counterclockwise direction (FIG. 1) to move the feed finger 64 from the home position shown in FIG. 6 through the position shown in FIG. 7 to the fully forward or extended position shown in FIG. 8. During the remainder of the cycle the cam 30 drives the feed finger 64 from the position in FIG. 8 through the fully retracted position shown in FIG. 9 and thereafter the cam 30 pivots the lever 53 counterclockwise through a small arc to return the feed finger 64 to the home position shown in FIG. 6. The slide 62 carries a pin 68 on which a roller 69 is rotatably mounted. A lever 70 mounted on the pivot 71 secured to the frame 21 has a cam track generally indicated at 72. The cam track 72 is shown to be formed by a slot 73 formed in the lever 70. The roller 69 is received in the slot 73. The lever 70 has a forked end 74 which receives a roller 75 (FIG. 16) mounted on a post 76 to provide a pin and cut-out connection. The post 76 is secured to a plate-like carrier 77. The carrier 77 is guided in oppositely facing channel sections or guides 78 and 79. The channel sections 78 and 79 are secured to plates 80 and 81 secured to the frame 21.

As the lever 53 pivots during an operating cycle and while the feed finger 64 is being driven as indicated above, the roller 69 cooperates with the cam track 72 to pivot the lever 70 generally counterclockwise as viewed in FIG. 1 and thereafter to pivot the lever 70 clockwise. Thus, the carrier 77 which carries an ink pad generally indicated at 83 is first moved from the retracted or home position shown in FIGS. 1 and 2 to the extended or inking position shown in FIG. 4. In the inking position, the ink pad 83 is disposed between the print head assembly 46 and platen 84 which comprises part of the platen structure. The print head assembly 46 is shown in the same position in both FIGS. 4 and 7. The cam 32 is configured to initially raise the print head assembly 46 slightly so that the carrier 77 and its ink pad 83 can be moved to the extended position in the gap between the print head assembly 46 and the platen 84. Thereafter, when the carrier 77 is in the extended position, the profile of cam 32 causes the print head assembly 46 to be driven into ink receiving contact with the ink pad 83 and thereafter the profile of the cam 32 causes the print head assembly 46 to be raised, that is, driven away from the ink pad 83. While the print head assembly 46 is raised, the lever 53 begins its retracting movement and thus the roller 69 cooperates with the cam track 72 to return the carrier 77 and the ink pad 83 to the home position. As soon as the ink pad 83 and its carrier 77 have moved (to the left as viewed in FIG. 4) clear of the print head assembly 46 and cam 32 drives the print head assembly 46 to the printing position shown in FIG. 9. In the printing position the record members R are printed and the ink pad 83 is simultaneously inked by means of the cartridge 50.

In accordance with a feature of the invention the length of travel of the feed finger 64 can be adjusted without affecting the travel of the carrier 77 and the ink pad 83. Adjustment of the bracket 55 to the left will decrease the stroke of the lever 53 and consequently the stroke of the feed finger 64, whereas shifting of the bracket 55 to the right will increase the strokes of the lever 53 and the feed finger 64. It is noted that the cam track 72 is comprised of rise or inclined portion 84′ and dwell portions 85 and 86. Adjustment of the bracket 55 will change the initial position of the roller 69 in the cam track 72. More particularly the roller 69 will be positioned either generally to the left or generally to the right of the position shown in FIG. 1 depending upon the adjustment of the plate of the bracket 55. The adjustment of the bracket 55 is necessarily limited. The dwell portions 85 and 86 are so selected that irrespective of the length of stroke through which the lever 53 and the slide 62 are set to move, the roller 69 will only contact the rise portion 84' during the central or intermediate portion of the forward and retract travel of the slide 62. The cam track 72 and the roller 69 constitute a lost-motion connection between the slide 62 and the inker which includes the carrier 77 and the ink pad 83.

When the ink pad 83 and the carrier 77 are in the position shown in FIG. 4, the carrier 77 is supported by a support 85 mounted to the platen structure 82 in front of the platen 84. Screws 86' which pass through elongated slots 87 adjustably secure the support 85' in position. Screws 86' enable the support 85' to be positioned optimally relative to the carrier 77 by enabling the support 85' to be adjusted either to the left or to the right as viewed in FIG. 4. As seen in FIG. 4, when the print head assembly 46 moves into ink-receiving contact with the ink pad 83, the carrier 77 is supported not only at its left end (FIG. 4) by the channel sections 78 and 79, but also at its right end by the support 85'. Accordingly, the ink pad 83 and the carrier 77 are well supported while the print head assembly 46 is in ink-receiving contact with the pad 83 and yet neither the channel sections 78 and 79 and the associated plate 81 nor the support 85' interfers with easy access to the platen 84 as is beneficial for instance during threading of the apparatus 20 with a web W of record members R.

Figure 15:
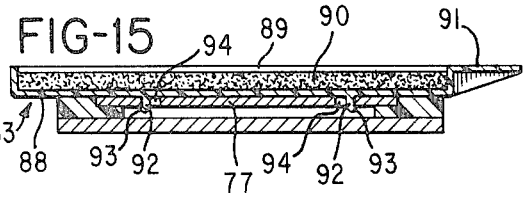
FIG. 15 is a sectional view taken generally along the line 15—15 of FIG. 2.

With reference to FIG. 15, there is shown an inker body 88 having a rectangular recess 89 for receiving a rectangular pad-like section of porous ink-receptive material 90. The inker body 88 has a handle 91 and a pair of flexible resilient fingers 92 formed integrally therewith. The fingers carry oppositely facing projections 93 which are shown to extend through holes 94 in the carrier 77 and releasably engage with the underside of the carrier 77. By positioning the ink pad 83 over the carrier 77 so that the fingers 92 are in alignment with the holes 94 and by depressing the ink pad 83, the fingers 92 will enter the holes 94 and the projections 93 will releasably hold the ink pad 83 in position.

With reference to FIGS. 2 and 3, there is shown a decelerator generally indicated at 95 which comprises a plate 96 having an upstanding flange or abutment 97. The plate 96 has elongated slots 98 through which screws 99 extend and are threadably secured to the plate 80. A cushion in the form of a flexible resilient O-ring 100 is received about the abutment 97. The O-ring 100 is in alignment with the rear face 101 of the carrier 77. As the lever 70 returns the carrier 77 to its home position shown in FIG. 3, the end 101 of the carrier 77 is driven against the O-ring 100, thereby bringing the carrier 77 to a stop with a minimum of vibration being transmitted to the remainder of the apparatus 20. The cushioning provided by the O-ring 100 is particularly advantageous in that there is slight clearance between the forked end 74 and the roller 75.

Figure 11:
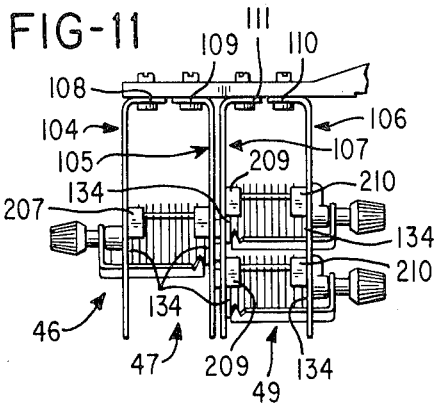
FIG. 11 is a top plan view of the print head assembly with the printing bands removed.
Figure 12:
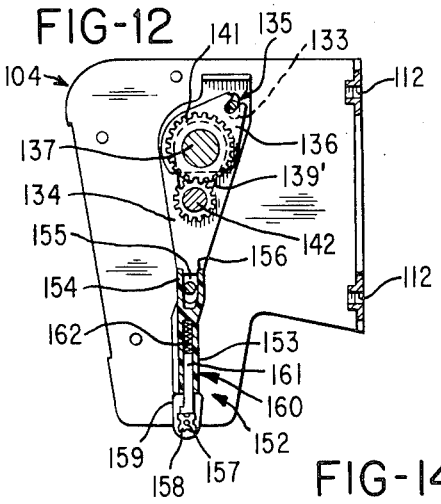
FIG. 12 is a view taken generally along line 12—12 of FIG. 6, with the printing band being omitted for the sake of clarity.
Figure 13:
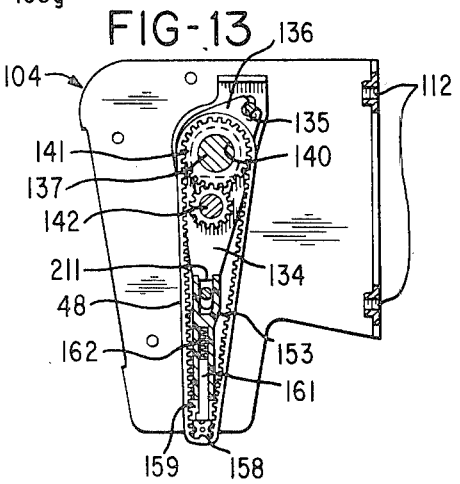
FIG. 13 is a view similar to FIG. 12, but showing the printing band received about a drive wheel of the support.

With reference to FIG. 11, which shows the print head assembly 46 minus plates 102 and 103 and printing bands 48, it is apparent that each print head 47 and 49 is comprised of a pair of spaced-apart side plates 104 and 105, and 106 and 107, although conceivably adjacent print heads can share a common side plate. Plates 104 and 105 have flanges 108 and 109 which extend toward each other, and the side plates 106 and 107 have flanges 110 and 111 that extend toward each other. Each of the flanges 108, 109, 110 and 111 has a pair of tapped holes 112, as best shown in FIG. 12.

Figure 10:
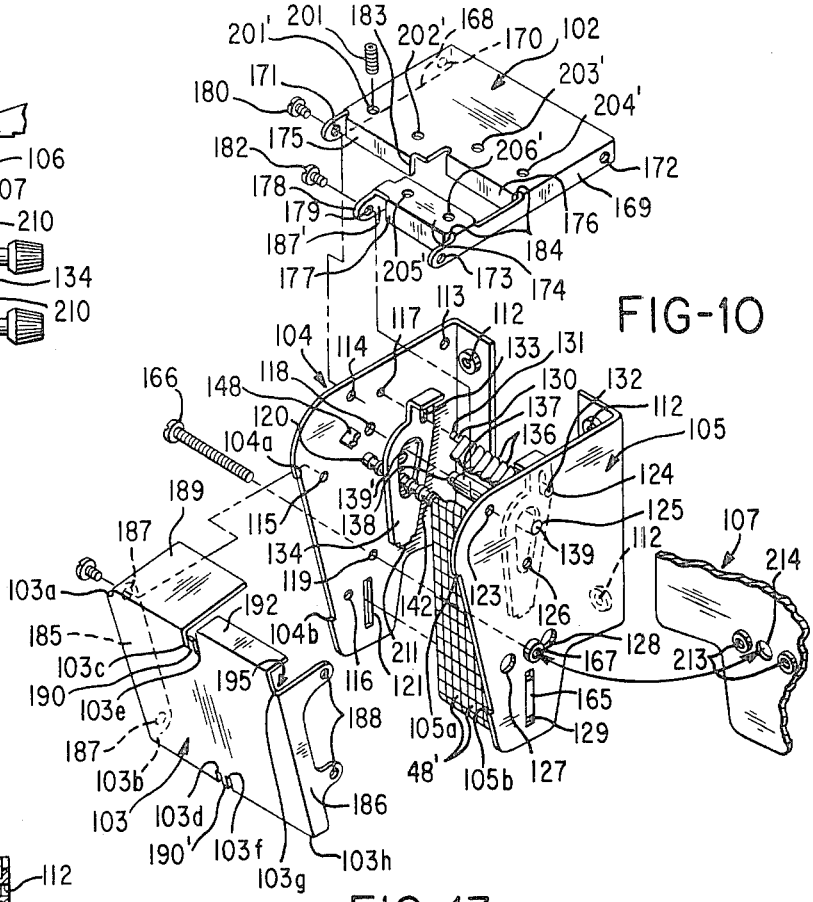
FIG. 10 is an exploded perspective view showing fragmentary portions of the print head assembly of the apparatus.

With reference to FIG. 10, the side plate 104 has holes 113, 114, 115, 116, 117, 118 and 119 and an elongated slot 121. The side plate 105 has holes 123, 124, 125, 126, 127 and 128 and an elongated slot 129.

Figure 14:
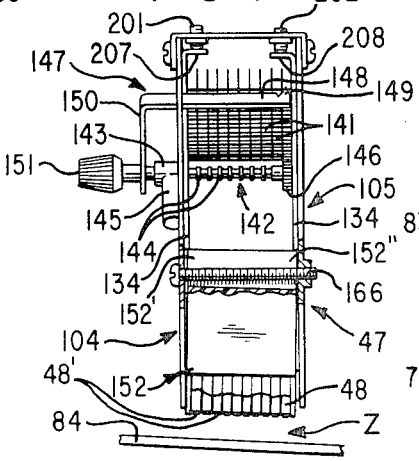
FIG. 14 is a front elevational view of one of the print heads with the printing bands broken away for clarity.

An annular shaft or rod 130 having reduced annular ends or end portions 131 and 132 received in respective holes 117 and 124 passes through elongated slots 133 in adjusting plates 134 and in elongated slots 135 in spacer plates 136. An annular rod or shaft 137 having reduced diameter end portions 138 and 139 received in respective holes 118 and 125 passes through cutouts 139' in adjusting plates 134 and through holes 140 in toothed drive wheels 141. A selector shaft 142 is mounted in a bushing 143 secured to the plate 104. The selector shaft 142 has a plurality of spaced-apart annular rings 144 which cooperate with a detent disposed in a tubular member 145 which opens into the bore of the bushing 143. The selector shaft 142 carries a gear 146 which can mesh with any one of the gears 141. An indicator generally indicated at 147 includes a longitudinally extending portion 148 which extends parallel to the axis of the drive wheels 141 and carries a pointer 149. The indicator 147 also includes a radially extending portion 150 joined to the longitudinally extending portion 148. The portion 150 is secured to the selector 142 between the bushing 143 and a knob 151. As shown in FIG. 14, the pointer 149 is aligned with the gear 146 and with the drive wheel with which the gear 146 cooperates, thereby in the position shown in the drawings, indicating that rotation of the knob 151 will cause rotation of the printing band 48 which is trained about the endmost drive wheel 141. By shifting the selector 142 to the left (FIG. 14) using the knob 151, the gear 146 can be meshed with any selected drive wheel 141. In that the gear 146 and the pointer 149 move as a unit, the pointer 149 will always be aligned with the gear 146 and will always indicate the drive wheel and consequently the printing band 48 with which the gear 146 is in driving cooperation.

A support generally indicated at 152 comprises a body 153 composed of plastics material. The upper end of the body 153 has a U-shaped portion 154 defining an open-ended channel 155 which is also open at the top 156. The body 153 mounts a shaft 157 which rotatably mounts wheels 158 which correspond to respective drive wheels 141. Spacers 159 separate adjacent wheels 158 from each other. The spacers 159 are large enough to separate adjacent printing bands 48 adjacent the printing zone Z. An individual detent 160, comprising a member 161 and a spring 162, acts on each respective wheel 158. The body 153 has integrally formed lugs 164 (FIG. 2) and 165 (FIG. 10) which are guidingly received in respective slots 121 and 129. Screw 166 passes through a hole 119 in the plate 104 and through the channel 155 and is threadably received in a threaded hole 167.

The plate 102 has a pair of flanges 168 and 169. The flange 168 has holes 170 and 171 and the flange 169 has holes 172 and 173. A plate portion 174 is integrally joined with the flange 169. The plate 102 has a pair of offset flanges 175 and 176 and the plate portion 174 has flanges 177 and 178. The flange 178 has a hole 179 aligned with the hole 123. The plate 102 is disposed at the tops of the side plates 104, 105, 106 and 107. Screws 180 pass through holes 170 and 171 and are threadably received in threaded holes 113 and 114. Screws 181 pass through holes 172 and 173 in the flange 169 and are threadably received in threaded holes in the side plate 106. Screw 182 extends through the hole 179 and is threadably received in the hole 123. As best seen in FIG. 1, the side plate 104 is snugly received in an opening 168' between the flange 168 and the flange 175, the side plate 105 is positioned against a face 183 of the flange 175, the side plates 105 and 106 are snugly received in an opening 187' between the flanges 177 and 178, and the side plate 106 is snugly received in openings 184 between the flanges 169 and 176 and 177. The plate 103 has flanges 185 and 186. The flange 185 has holes 187 and the flange 186 has holes 188. The plate 103 also has four flanges 189, 190, 190' and 192. The flanges 185 and 189 are laterally spaced apart so that shoulders 104*a* and 104*b* of the plate 104 can fit against respective shoulders 103*a* and 103*b* on the plate 103. The plates 105, 106 and 107 have shoulders 105*a* and 105*b*, 106*a* and 106*b*, and 107*a* and 107*b*. The flanges 186 and 192 are laterally offset to provide an opening 195 in which the side plate 106 can be snugly received. The plate 103 also has shoulders 103*c* through 103*h*. The shoulders 105*a* and 105*b* abut respective shoulders 103*c* and 103*d*, the shoulders 107*a* and 107*b* abut respective shoulders 103*e* and 103*f*, and shoulders 106*a* and 106*b* abut respective shoulders 103*g* and 103*h*. The plates 104, 105, 106 and 107 are constructed identically except as otherwise noted. It is thus apparent that the plates 44, 102 and 103 rigidly structurally interconnect the plates 104, 105, 106, 107 into a sturdy head assembly 46.

With reference to FIGS. 1 and 10, set screws 201, 202, 203, 204, 205, and 206 are threadably received in respective threaded holes 201' through 206'. As shown in FIG. 14 for example, screws 201 and 202 contact flanges 207 and 208 of respective adjusting plates 134. The flanges 207 and 208 of the adjusting plates 134 of the print head 47 extend toward each other laterally of respective side plates 104 and 105. Flanges 209 and 210 of the adjusting plates 134 extend toward each other laterally of respective side plates 107 and 106. The adjusting plates 134 includes a projection 211 received in the channel 155 in the U-shaped end 154 of the support body 153. In that the support 152 is guided for straight line movement by means of its lugs 164 and 165 received in respective slots 121 and 129 and because the rod 130 is received in elongated slots 133, the plates 134 are also guided for straight line movement. The print head 47 has a pair of adjusting plates 134 disposed between and in contact with the side plates 104 and 105 and endmost drive wheels 141. It is apparent from FIG. 14 that adjustment of screws 201 and 202 will cause respective ends 152' and 152'' of the support 152 to be moved selected distances against the forces exerted by the printing bands which are under tension. More particularly, the adjusting plates 134 exert downward forces on the ends 152' and 152'' and the printing bands 48 acting against the wheels 158 exert an upward force on the support so therefore in the event that set screws 201 and/or 202 are rotated to move in an upward direction as viewed in FIG. 14, the forces which the printing bands 48 exert upwardly on the wheels 158 will prevent the forked end 154 from losing contact with the adjusting plates 134 and will prevent the flanges 207 and 208 from losing contact with respective set screws 201 and 202. In FIG. 14, the support 152 has been oriented exaggeratedly but in parallel relationship with respect to the upper surface of the platen 84 by use of adjusting screws 201 and 202. Once this adjustment has been made, screw 166 is tightened, thereby clamping the support 152 securely in the adjusted position. There is enough clearance between the plates 104 and 105 so that the support 152 can be skewed relative to the plates 104 and 105 as shown exaggeratedly in FIG. 14. In order to change the adjustment, the screw 166 is loosened and set screws 201 and 202 are adjusted until the printing elements 48' on bands 48 are correctly oriented with respect to the platen and thereupon screw 166 can be tightened again. The same adjusting procedure applies to the print head 49.

With respect to the print head 49 which can print two rows of data, there are two sets of printing bands 48, two sets of drive wheels 141, two supports 152, two sets of adjusting plates 134, and associated components. Accordingly, the print head 49 differs to the extent that the side plates 106 and 107 are provided with two slots 212 for receiving lugs 164 and 165. The plates 106 and 107 also have the necessary holes for accommodating the selector shafts 142 and rods 130 and 137. The plate 107 has internally threaded bosses 213 for threadably receiving respective screws 166. Bosses 166 extend into clearance holes 127 and 128 in the plate 105. The plate 107 also has a clearance hole 214 for receiving the internally threaded boss 167 of the plate 105.

Other embodiments and modifications of this invention will suggest themselves to those skilled in the art, and all such of these as come within the spirit of this invention are included within its scope as best defined by the appended claims.

I claim:

1. Printing apparatus, comprising: a platen, a print head cooperable with the platen, a feed finger, means for driving the feed finger in a forward direction from a home position to feed a web of record members to a printing position between the print head and the platen and for driving the feed finger in the return direction to the home position, an inker, means driven by the driving means for actuating the inker into and out of inking cooperation with the print head, and manually settable means for varying the stroke of the driving means to vary the travel of the feed finger, the actuating means including means to effect travel of the inker through the same distance irrespective of the stroke of the driving means as determined by the setting of the settable means.

2. Apparatus as defined in claim 1, wherein the driving means comprises a lever connected to the feed finger, a follower carried by the lever, a pivot for pivotally mounting the lever, and a cam for driving the follower, wherein the actuating means comprises cam means driven by the lever and coupled to the inker, wherein the manually settable means comprises means for adjusting the position of the pivot.

3. Apparatus as defined in claim 1, wherein the actuating means comprises a cam having an inclined portion and a dwell portion at each end of the inclined portion.

4. Apparatus as defined in claim 1, wherein the actuating means comprises a lever, means for pivotally mounting the lever at its one end, means connecting the lever to the inker at the other end of the lever, a cam track carried by the lever, a roller driven by the driving means and cooperable with the cam track, the cam track having an inclined portion and a dwell portion at each end of the inclined portion.

5. Apparatus as defined in claim 1, wherein the inker comprises an ink pad, a carrier for mounting the ink pad, means disposed at one side of the platen for guiding the carrier into inking position between the print head and the platen and for supporting the platen, and means disposed at the other side of the platen for supporting the carrier while the print head is in inking position relative to the ink pad, wherein the platen is readily accessible in the region between the respective supporting means to facilitate threading of the apparatus with a web of record members.

6. Apparatus as defined in claim 1, wherein the inker includes a reciprocably mounted carrier, the actuating means comprising a pivotally mounted lever, a pin-and-cutout connection between the lever and the carrier, the lever being movable to drive the carrier from a home position to a position between the print head and the platen and to drive the carrier back to the home position, and a decelerator for stopping the slide at the home position.

7. Apparatus as defined in claim 6, wherein the decelerator comprises an abutment, and a resilient O-ring received about the abutment.

8. Printing apparatus, comprising: an electric motor, a speed reducer driven by the electric motor, a cam shaft driven by the speed reducer, a first cam secured to the shaft, a platen, a print head cooperable with the platen, a first lever, a pivot for mounting the first lever, a follower carried by the first lever and driven by the first cam, a feed finger for feeding a web of record members to a printing position between the print head and the platen, an inker comprising an ink-receptive member, a second pivotally mounted lever for driving the ink-receptive member into and out of inking position relative to the print head, cam means for driving the second lever, means for drivingly connecting the first lever to the feed finger and to the cam means, a second cam secured to the cam shaft for actuating the print head into and out of cooperation with the platen, and means for varying the position of the pivot to vary the stroke of the first lever and consequently the stroke the feed finger, the cam means being effective only during the central portion of the stroke of the feed finger so that variation in the stroke of the first lever does not affect the length of travel of the ink-receptive member.

9. Printing apparatus, comprising: a print head and a cooperable platen, a feed finger for feeding a web of record members to a printing position between the print head and the platen, an inker having an ink-receptive member movable into and out of an inking position between the print head and the platen, means for driving the feed finger, means for varying the stroke of the driving means and hence the stroke of the feed finger, and means including a lost-motion connection connecting the driving means and the inker for driving the inker through the same distance irrespective of the stroke of the feed finger.

10. Printing apparatus, comprising: a print head and a cooperable platen, a carrier, an ink pad carried by the carrier, means disposed at one side of the platen for guiding the carrier for reciprocable movement from a location in which the ink pad is out a gap between the print head and the platen to a position in which the ink pad is in the gap and for supporting the carrier, and a support disposed at the other side of the platen for supporting the carrier while the ink pad is in the gap to enable inking of the print head, wherein the platen is readily accessible in the region between the guiding and supporting means and the support to facilitate threading of the apparatus with a web of record members.

11. Apparatus as defined in claim 10, including a decelerator for stopping the carrier, the decelerator comprising a resilient member.

12. Apparatus as defined in claim 10, wherein the ink pad comprises a holder, ink-receptive material carried by the holder, resilient fingers on the holder for removably snap-fitting the holder to the carrier.

13. Printing apparatus, comprising: an actuator, a pair of plates secured to the actuator, means for holding the plates in fixed generally parallel relationship to each other, a plurality of drive wheels, means mounted by the plates for rotatably mounting the drive wheels between the plates, a selector for selectively driving the drive wheels, a support disposed between the plates, means mounting the support for movement toward and away from the drive wheels, a plurality of printing bands trained about the support and respective drive wheels, each band having a plurality of different printing elements, and independent means acting on the support at spaced-apart locations for orienting the support to position the printing elements parallel to a platen.

14. Apparatus as defined in claim 13, including means for locking the support in the selected position.

15. Printing apparatus, comprising: a print head comprising a pair of side plates, a series of drive wheels rotatably mounted between the side plates, a support mounted between the side plates, a series of printing bands trained about the support and respective drive wheels, each band having a plurality of different printing elements, an adjusting plate between each side plate and a respective endmost drive wheel of the series, the adjusting plates being capable of exerting independent forces against opposite ends of the support, and means for individually adjusting the adjusting plates to cause the ends of the support to move through the desired distances so that the support and consequently the printing elements are oriented in parallel relationship to a platen.

16. Apparatus as defined in claim 15, wherein each adjusting plate has an elongated slot, and a rod extending through the slots and mounted at its opposite ends by the side plates, the support and the side plates having cooperable means for guiding the support for movement toward and away from the drive wheels, the one ends of the adjusting plates being captive by the support and the other ends of the adjusting plates being guided by the rods so that the adjusting plates move in a substantially straight line.

17. Apparatus as defined in claim 15, wherein each adjusting plate has an elongated slot, a rod extending through the slots and mounted at its opposite ends by the side plates, the support and the side plates having cooperable means for guiding the support for movement toward and away from the drive wheels, the one ends of the adjusting plates being captive by the support and the other ends of the adjusting plates being guided by the rods so that the adjusting plates move in a substantially straight line, each adjusting plate having a flange, and a separate adjusting screw for bearing against each flange to provide individual adjustment for the adjusting plates.

18. Apparatus as defined in claim 15, each adjusting plate having a flange, each adjusting means comprising a screw bearing on the respective flange, the flanges and the support being disposed in opposite directions from the drive wheels.

19. Apparatus as defined in claim 15, wherein the adjusting means are disposed above the drive wheels to be accessible from above the print head.

20. Printing apparatus, comprising: a print head having a pair of side plates, a series of drive wheels rotatably mounted by and between the side plates, a support mounted by and between the side plates, a plurality of printing bands trained about the support and respective drive wheels, each band having a plurality of different printing elements, a separate adjusting plate disposed between each side plate and a respective endmost drive wheel of the series, the adjusting plates having respective flanges and being in contact with opposite ends of the support, and separate means cooperable with the respective flanges for actuating the adjusting plates to cause the ends of the support to be moved relative to the drive wheels by different amounts to enable the printing elements to be oriented in parallel relationship with respect to a platen, the flanges being above the drive wheels and the support being below the drive wheels.

21. Apparatus as defined in claim 20, wherein each actuating means comprises a screw accessible from above the print head.

22. Printing apparatus, comprising: a print head having a pair of side plates, a series of drive wheels rotatably mounted by and between the side plates, a support mounted by and between the side plates, a plurality of printing bands trained about the support and respective drive wheels, each band having a plurality of different printing elements, and individual means accessible from above the drive wheels to exert forces on opposite ends of the support for orienting the support to position the printing elements in parallel relationship with respect to a platen.

23. Printing apparatus, comprising: an actuator, a print head comprising a pair of separate spaced-apart side plates secured to the actuator, a series of drive wheels rotatably mounted by and between the side plates, a support mounted by and between the side plates, a plurality of printing bands trained about the support and respective drive wheels, each band having a plurality of different printing elements, a first structural plate keyed to the ends of the side plates opposite the actuator and a second structural plate disposed at the tops of the side plates and secured to the side plates, the first and second structural plates and the actuator locking the plates in predetermined relationship relative to each other.

24. Apparatus as defined in claim 23, further comprising means including separate members carried by the second structural plate for orienting the support to position the printing elements in parallel relationship relative to a platen.

25. Apparatus as defined in claim 23, further comprising means including a pair of screws threadably received in the second structural plate for orienting the support to position the printing elements in parallel relationship relative to a platen.

26. Printing apparatus, comprising: a print head assembly including at least two print heads; each print head having means for mounting a series of drive wheels, a support, a plurality of printing bands trained about the support and respective drive wheels, each band having a plurality of different printing elements, and individual means to exert forces on opposite ends of the support for orienting the support relative to the drive wheels to position the printing elements in a plane with respect to the printing elements of each other print head.

27. Apparatus as defined in claim 26, wherein the print heads include spaced-apart side plates, a first plate disposed above the drive wheels and a second plate disposed at the one ends of the side plates for securing the side plates in a predetermined position relative to each other.

* * * * *